US008727897B2

(12) United States Patent
Ochi

(10) Patent No.: US 8,727,897 B2
(45) Date of Patent: May 20, 2014

(54) AMUSEMENT APPARATUS

(75) Inventor: Yasushi Ochi, Kaizuka (JP)

(73) Assignee: BLD Oriental Co., Ltd., Izumisano Osaka Prefecture (JP)

( * ) Notice: Subject to any disclaimer, the term of this patent is extended or adjusted under 35 U.S.C. 154(b) by 0 days.

(21) Appl. No.: 13/497,102

(22) PCT Filed: Apr. 21, 2010

(86) PCT No.: PCT/JP2010/002877

§ 371 (c)(1),
(2), (4) Date: Mar. 20, 2012

(87) PCT Pub. No.: WO2011/058672

PCT Pub. Date: May 19, 2011

(65) Prior Publication Data

US 2012/0184177 A1 Jul. 19, 2012

(30) Foreign Application Priority Data

Nov. 13, 2009 (JP) ..... 2009-259837

(51) Int. Cl.
*A63G 31/00* (2006.01)
*A63H 33/22* (2006.01)

(52) U.S. Cl.
USPC ..... 472/63; 446/219

(58) Field of Classification Search
USPC ..... 446/219; 472/63, 116; 359/616, 838, 359/850; 482/35
See application file for complete search history.

(56) References Cited

U.S. PATENT DOCUMENTS

| | | | | | |
|---|---|---|---|---|---|
| 3,335,693 | A | * | 8/1967 | Murray, Jr. | 116/20 |
| 3,642,342 | A | * | 2/1972 | De Larrain | 359/616 |
| 4,343,464 | A | * | 8/1982 | Dose | 472/116 |
| 4,546,965 | A | * | 10/1985 | Baxter et al. | 482/35 |
| 4,805,898 | A | | 2/1989 | Jacober | |
| 4,815,801 | A | * | 3/1989 | Anderson | 359/616 |
| 4,901,998 | A | * | 2/1990 | Griffith | 473/417 |
| 5,225,934 | A | * | 7/1993 | Kroll | 359/616 |
| 5,407,393 | A | | 4/1995 | Schmidt | |
| 5,855,520 | A | * | 1/1999 | Gitter et al. | 472/63 |
| 6,582,315 | B1 | | 6/2003 | Formanski | |

(Continued)

FOREIGN PATENT DOCUMENTS

| | | | |
|---|---|---|---|
| EP | 2058030 | A1 | 5/2009 |
| JP | 111677/1977 | U | 3/1979 |

(Continued)

OTHER PUBLICATIONS

International Search Report; Application No. PCT/JP2010/002877; Jun. 22, 2010; Japanese Patent Office.

(Continued)

*Primary Examiner* — Gene Kim
*Assistant Examiner* — Alyssa Hylinski
(74) *Attorney, Agent, or Firm* — Stevens & Showalter LLP

(57) ABSTRACT

A game apparatus 100 of the present invention includes a mount body 200 and a decoration stand 300. A hollow cavity for letting a user play is formed to mount body 200. And the hollow cavity inner wall is mirrors 220. A decoration stand 300 is located on outside the mount body 200, and part or all of the turn board provided on decoration stand 300 is viewable from the hollow cavity of the mount body 200.

10 Claims, 5 Drawing Sheets

(56) References Cited

U.S. PATENT DOCUMENTS

| | | | | |
|---|---|---|---|---|
| 6,786,830 | B2 * | 9/2004 | Briggs et al. | 472/128 |
| 2003/0060333 | A1 * | 3/2003 | Sudeith | 482/37 |
| 2009/0012122 | A1 | 1/2009 | Branch et al. | |
| 2010/0048310 | A1 | 2/2010 | Ochi | |

FOREIGN PATENT DOCUMENTS

| | | | |
|---|---|---|---|
| JP | 139254/1978 | U | 4/1980 |
| JP | 125903/1982 | U | 4/1984 |
| JP | 62-129072 | A | 6/1987 |
| JP | 73404/1989 | U | 2/1991 |
| JP | 4-15989 | U | 2/1992 |
| JP | H07-098782 | A | 4/1995 |
| JP | 7-265548 | A | 10/1995 |
| JP | 8-38649 | A | 2/1996 |
| JP | 8-211330 | A | 8/1996 |
| JP | H08-196747 | A | 8/1996 |
| JP | 8-229244 | A | 9/1996 |
| JP | 9-108449 | A | 4/1997 |
| JP | H11-299635 | A | 11/1999 |
| JP | 2000-116959 | A | 4/2000 |
| JP | 2000167254 | | 6/2000 |
| JP | 2000-197715 | | 7/2000 |
| JP | 2001-169864 | A | 6/2001 |
| JP | 2004-208844 | A | 7/2004 |
| JP | 2005-52305 | A | 3/2005 |
| JP | 2005-131215 | A | 5/2005 |
| JP | 2008-231904 | A | 2/2008 |
| JP | 2008-067741 | A | 3/2008 |
| JP | 2008073497 | A | 4/2008 |
| JP | 2008-536082 | A | 9/2008 |
| JP | 2009-11421 | A | 1/2009 |
| WO | 2006025108 | A1 | 3/2006 |

OTHER PUBLICATIONS

Naoki Turuoka; Written Opinion of the International Searching Authority; Application No. PCT/JP2010/002877; Jun. 22, 2010; Japanese Patent Office.

Ochi, Yasushi; U.S. Appl. No. 13/497,070; Apr. 21, 2010 I.A. Date; entitled Tree-Shaped Decoration Apparatus.

Ochi, Yasushi; U.S. Appl. No. 13/497,081; Apr. 21, 2010 I.A. Date; entitled Rotating Amusement Apparatus.

Ochi, Yasushi; U.S. Appl. No. 13/497,085; Apr. 21, 2010 I.A. Date; entitled Slide Device.

Ochi, Yasushi; U.S. Appl. No. 13/497,095; Apr. 21, 2010 I.A. Date; entitled Amusement Apparatus.

Ochi, Yasushi; U.S. Appl. No. 13/497,116; Apr. 21, 2010 I.A. Date; entitled Rocking Play Device.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002873; Jun. 8, 2010; Japanese Patent Office.

Tamotu Sakai; Written Opinion of the International Searching Authority; Application No. PCT/JP2010/002873; Jun. 8, 2010; Japanese Patent Office.

International Search Report; Application No. PCT/JP2010/002875; Jun. 1, 2010; Japanese Patent Office.

International Search Report; Application No. PCT/JP2010/002876; Jul. 6, 2010; Japanese Patent Office.

Tuneaki Oota; Written Opinion of the International Searching Authority; Application No. PCT/JP2010/002876; Jul. 6, 2010; Japanese Patent Office.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

* cited by examiner (A)

(B)

(A)

(B)

AMUSEMENT APPARATUS

FIELD OF THE INVENTION

The present invention relates to game apparatus and particularly with regard to one allowing users to go up and down the outside of the apparatus, and a mirror is provided on the inside of the apparatus.

BACKGROUND ART

Currently, a game apparatus with which young users such as infants can go up and down, is developed, and installed in amusement grounds and parks. For example, the concrete game apparatus provided with slides and a plurality of stairs parts formed in a surface is disclosed in following patent document 1 (Japanese Unexamined Pat. App. Pub. No. 2000-116959).

Problem Invention is to Solve

The game apparatus of Japanese Unexamined Pat. App. Pub. No. 2000-116959 is configured with an uphill stand, a slide and a tunnel provided in the dome-shaped uphill stands such as chevrons. The above game apparatuses are apt to be monotonous so that the playing user rarely want to play the game apparatus many times. Children such as infants intended to use the game apparatus are easy to continue interest, in a moving thing. As noted above, because the children are easy to continue interest in a moving thing, the request for such a playground equipment is strong.

The object of the invention is to provide a game apparatus with which children will continue to be interested, by making a movement of the part of the dome-shaped game apparatus.

SUMMARY OF THE INVENTION

A game apparatus of the present invention to solve the problem includes a mount body and a decoration stand. A hollow cavity is formed in the mount body for letting a user play, and an inner wall of the hollow cavity is a mirror. A decoration stand is provided outside the mount body forming the hollow cavity. Some parts or all of the turn board is viewable from the hollow cavity of the mount body.

Because a decoration stand is located at, the position where part or all of the turn board provided on the decoration stand is viewable from the hollow cavity of the mount body (the position where a decoration side of decoration stand 300 faces the cavity of mount body 200), when the turn board which has the decoration rotates, the rotative movement is reflected by a mirror on an inner wall of the mount body. By forming a hollow cavity shaped like a polygon, the image of the decoration member rotating in the turn board will be reflected repeatedly on the mirror provided on each side of the polygon. Thus, the user in a cavity can see an image changing like a kaleidoscope variously.

The game apparatus of the above aspect, it is desirable further comprising a gripping member provided in the mount body for letting a user to go up and down. The gripping members such as ladders provided outside of mount body can assist a user to go up and down. This gripping member provided on the mount body side is an imitation of a rock of a size that a user can get. Even more particularly, it is desirable that the surface of the game apparatus is coated in a shock absorber. As the shock absorber, urethane is preferably used. For example, the surface of the game apparatus, that is, the surface of the side and the decoration stand of the mount body can be coated with urethane. The surface of the game apparatus may be processed so as to imitate a rocky place by sharpening urethane.

Effect of the Invention

The present invention includes a mount body and a decoration stand. The mount body has a mirror provided on a hollow cavity inner wall, and the decoration stand is placed with its decoration side opposite the cavity. The decoration side of the decoration stand is the surface provided with a decoration turn board. Therefore, when the turn board which has the decoration rotates, the rotative movement is reflected by a mirror on an inner wall of the mount body. Thereby, even if it is the game apparatus of the mount body shape, by changing a picture to be reflected in the mirror inside variously, a game apparatus making the continued interest of children is provided.

Also, the gripping members such as ladders provided outside of mount body can assist a user to go up and down.

By coating a game apparatus 100 with shock absorber 400, even if a user bumps into the game apparatus by mistake, because a shock is cushioned by shock absorber 400, the shock absorber can absorb a shock.

BRIEF DESCRIPTION OF DRAWINGS

FIG. 3 is a front view of the decoration stand, and a perspective view showing the position to install a decoration stand in.

DESCRIPTION OF THE PREFERRED EMBODIMENT

Figure 1:
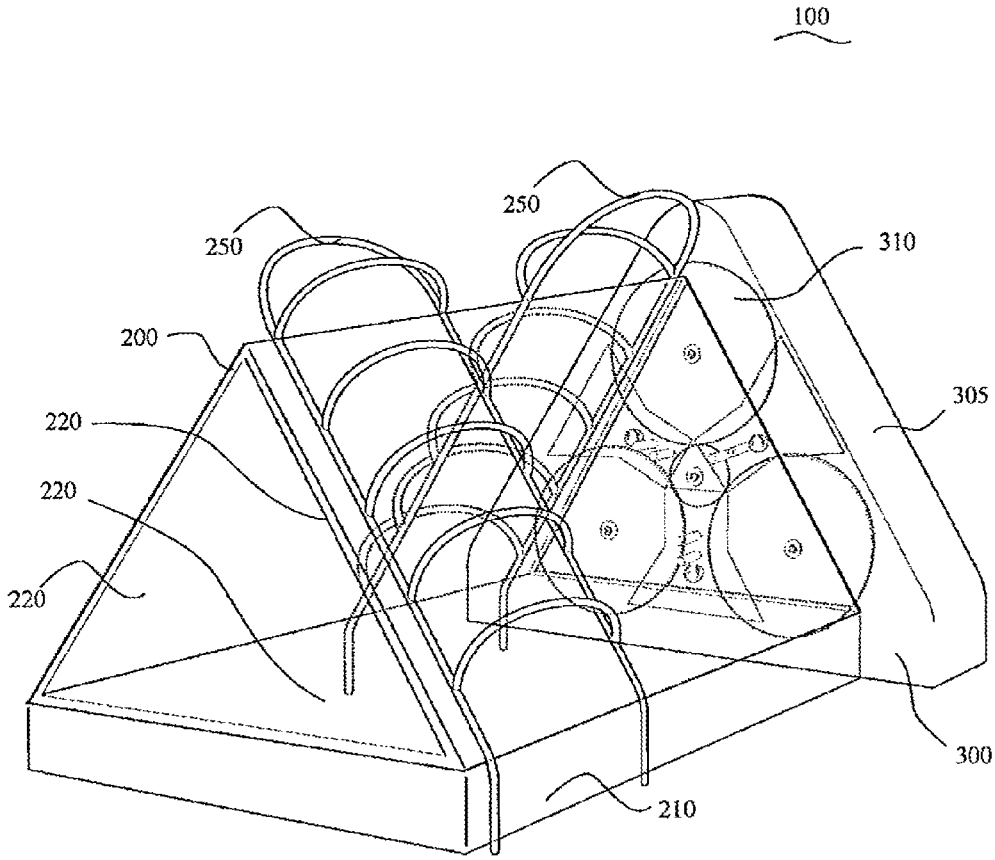
FIG. 1 is a perspective view showing a schematic configuration of game apparatus according to one embodiment of the present invention.
Figure 2:
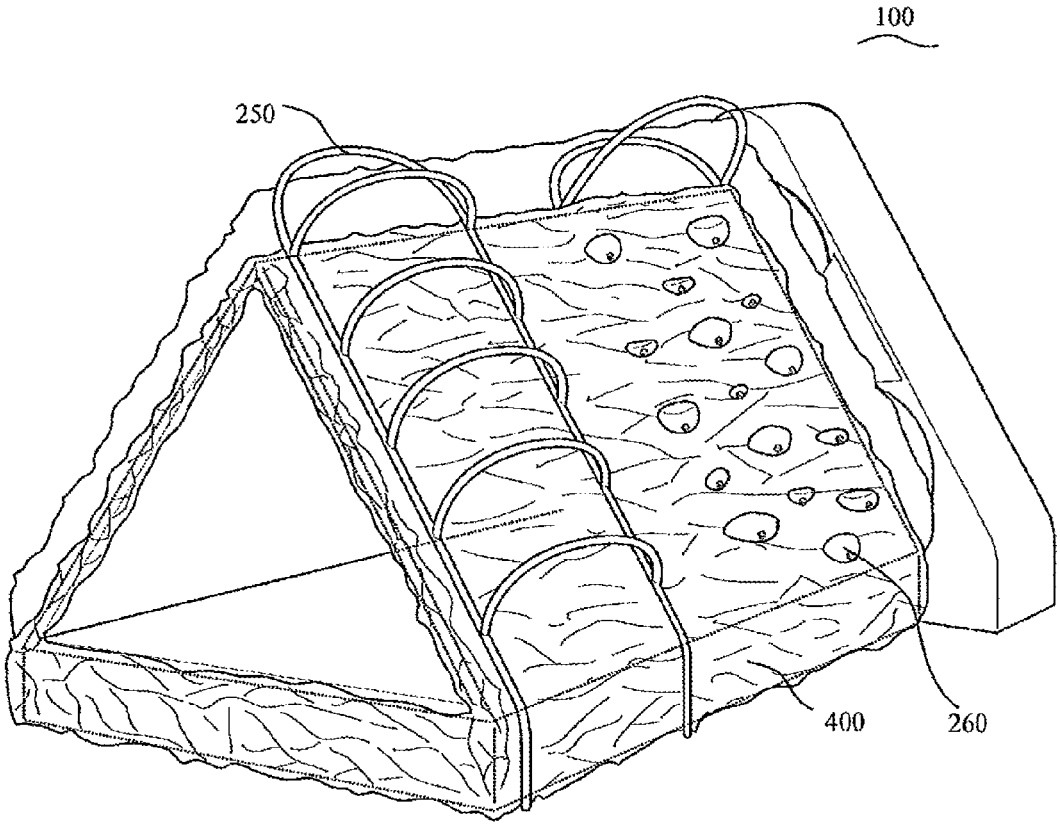
FIG. 2 is a perspective view showing a schematic configuration of game apparatuses provided a gripping member and coated a shock absorbent according to one embodiment of the present invention.
Figure 4:
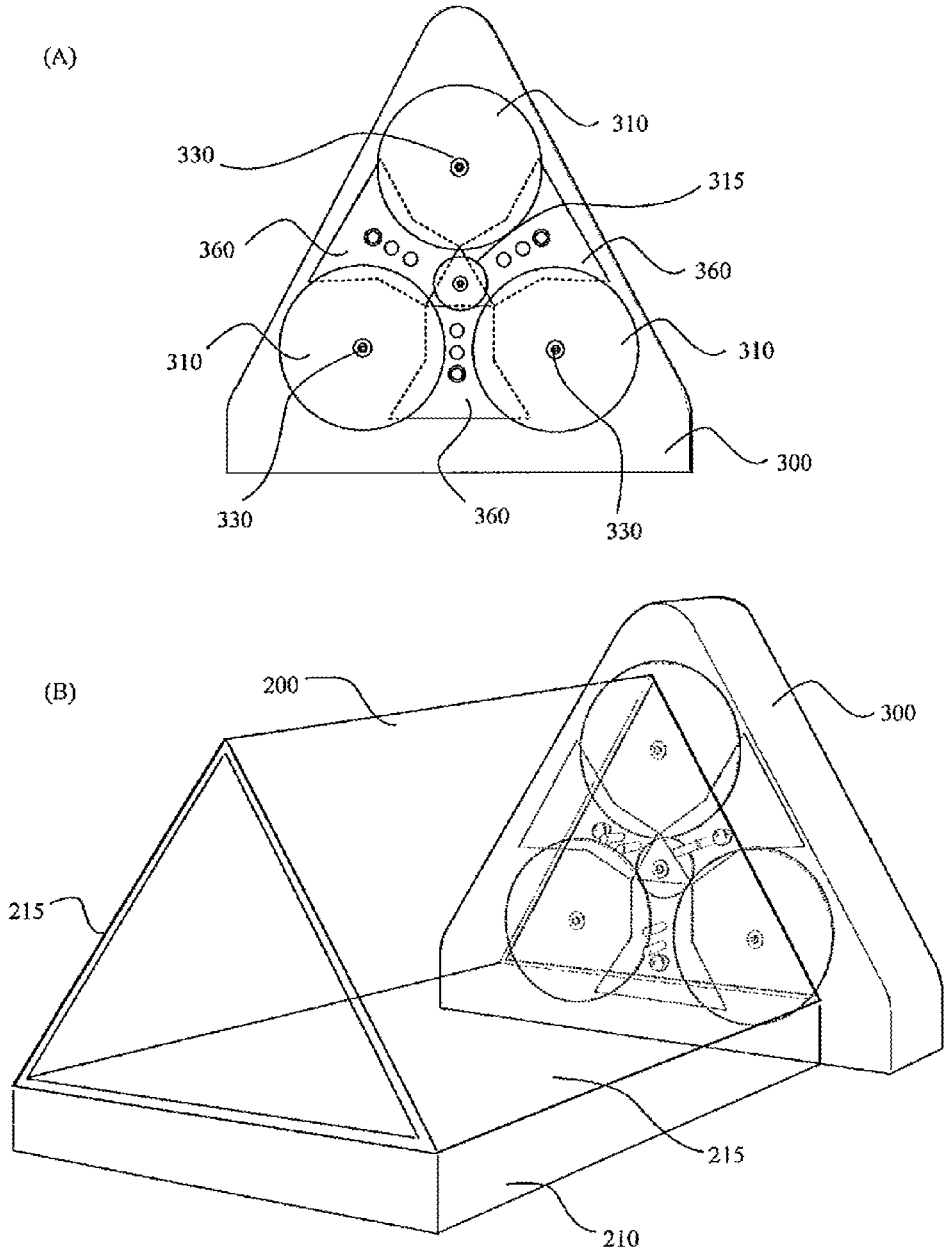
FIG. 4 is a front view and a perspective view showing the rotary mechanism of a decoration stand used for a game apparatus according to one embodiment of the present invention.

Hereinafter, a specific embodiment of a game apparatus 100 of the present invention will be described with reference to the accompanying drawing. FIG. 1 is a perspective view showing a schematic configuration of a game apparatus 100 according to one embodiment of the present invention. FIG. 2 shows decorative cover as will hereinafter be described in detail. FIG. 4 shows a schematic configuration of a rotary base. However, the details of all the parts which do not directly-relate to the present invention are omitted. As shown in FIG. 1, a game apparatus 100 of the present embodiment comprises a hollow mount body 200 and a decoration stand 300 installed by the side of the mount body.

The mount body 200 includes a base 210 in a top-view shaped as a rectangle and having the predetermined height and a pair of mount body sides 215. A triangle-shaped cavity in cross-section is formed in mount body 200 by coupling each upper end of the pair of mount body sides 215. The cross-section of the mount body 200 may be in the form of a polygon such as a quadrangle, a pentagon, the hexagon, as well as a triangle shape. In this case, it is desirable that the polygon is configured where the base top surface (corresponding to the intracavernous floor of mount body 200) is leveled. Note that, only a hollow shape of mount body 200 may be configured to form a polygon. That is, the outside of mount body 200 is configured to form a triangle, and the inside of mount body 200 is configured to form a polygon.

A mirror 220 is stuck on the inside of mount body 200. That is, the mirror 220 is stuck on the top surface of base 210 and on the entire inside surface of the pair of mount body sides 215. The mirror 220 may be a normal glass material or an acrylic material. Even a mirror sheet with evaporated aluminum on a transparent board may be preferable. A elevating means along which a user (an infant and children are assumed) is possible to go up and down, is provided on outside sides of the mount body 200. For example, in the present embodiment, a ladder 250 is set on the mount body sides 215 as elevating means.

Even more particularly, as shown in FIG. 2, gripping members 260 of various sizes imitating the shape of a rock, are formed as the elevating means, and each gripping member 260 is fixed to the mount body sides 215 at a scheduled distance. Decoration stand 300 will be formed next. A decoration stand 300 is provided in a side of the mount body 200, with a decorated rotary board provided on a one side of decoration stand 300.

A first side base 305 in generally the same configuration as a side shape (mean said a hollow shape) of mount body 200 is formed. The side base 305 is made with a triangle shape, in response to a side shape of triangle-shaped mount body 200.

When the side base 305 is installed so that the sides (a cavity) of mount body 200 and a first end face of side base 305 are placed next to one another, the size of the side base 305 is adjusted so that the side of mount body 200 hides, in relation to the second end face of the side base 305.

Figure 5:
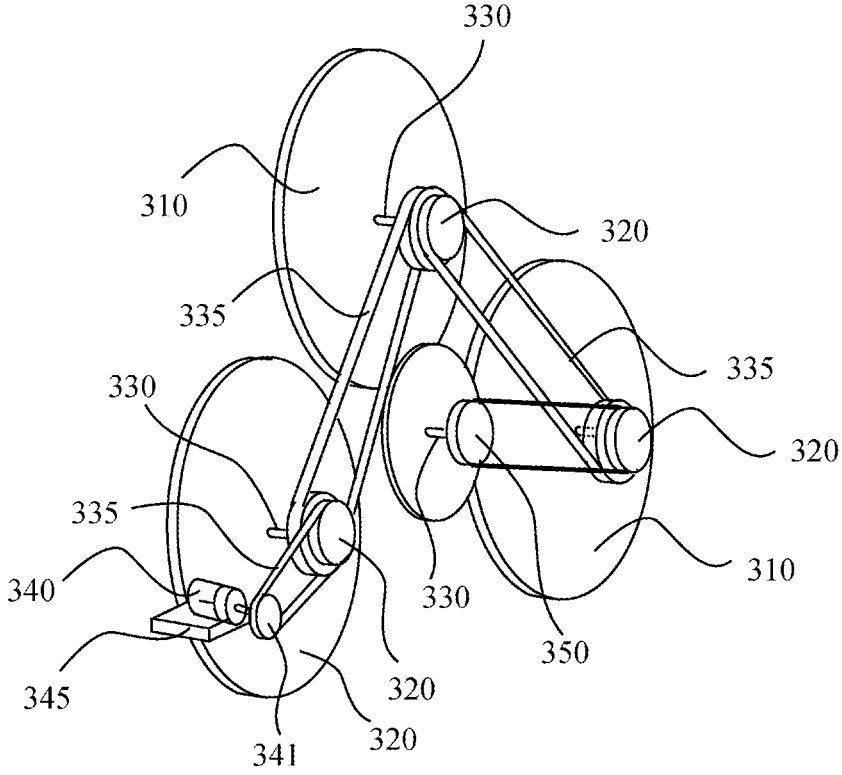
FIG. 5 illustrates pulleys and belts of the decoration stand.
Figure 5:
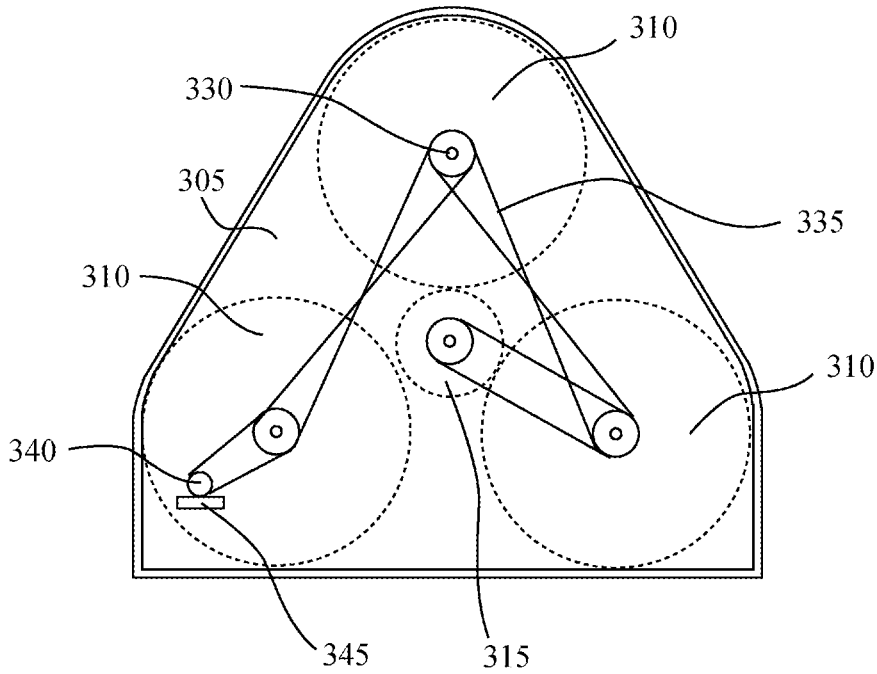

A rotatable decoration member is provided on the first end face of side base 305. FIGS. 4 and 5 illustrate a rotary mechanism of the decoration member as used herein. In FIG. 4, the first end face of the side base 305 is omitted on account of the explanation, but the first end face of the side base 305 will be placed between rotary board described below and a layered pulley 320, see FIG. 5. By layering a small and large pair of pulleys, a layered pulley (hereinafter called layered pulley 320) is formed, and the axis 330 is pivotally supported at the lower center part of the layered pulley 320. In the conditions where another end (the side where layered pulley 320 is not fixed to) of the axis 330 projects (i.e., the state that penetrated to side base 305), the axis 330 is placed in the first end face of side base 305. The placement of axis 330 is not limited, but, in accordance with exemplary embodiments, a plurality of axes 330 are placed in the first end face of side base 305 at a scheduled distance. In FIGS. 4 and 5, each axis 330 is placed in a triangular vertex and the center of gravity.

An endless belt 335 is engaged to a layered pulley 320 secured to an axis 330. For example, a small pulley 341 is fixed to a drive shaft of a drive motor 340 secured at a predetermined position. And among the axes 330, an endless belt 335 (hereinafter called the belt) is fastened to the pulley which is located below the layered pulley 320 secured to the axis 330 that is the nearest to drive motor 340, i.e., is fastened to the small pulley 341.

Next, an endless belt 335 fastened to a pulley located above the layered pulley 320 is fastened to the pulley located below the layered pulley 330 without an endless belt 335. And all layered pulleys 320 will be fastened with a belt 335. In accordance with exemplary embodiments, the endless belts 335 are fastened to layered pulleys 320 secured to axes 330 placed in the triangular vertex. Next a belt 335 is fastened to a pulley 350 located in the triangular center of gravity.

Figure 3:
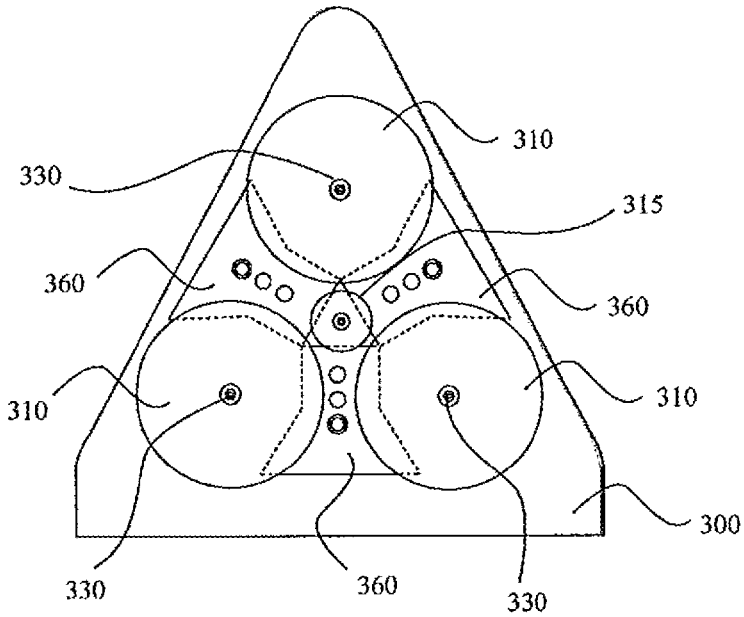
Figure 3:
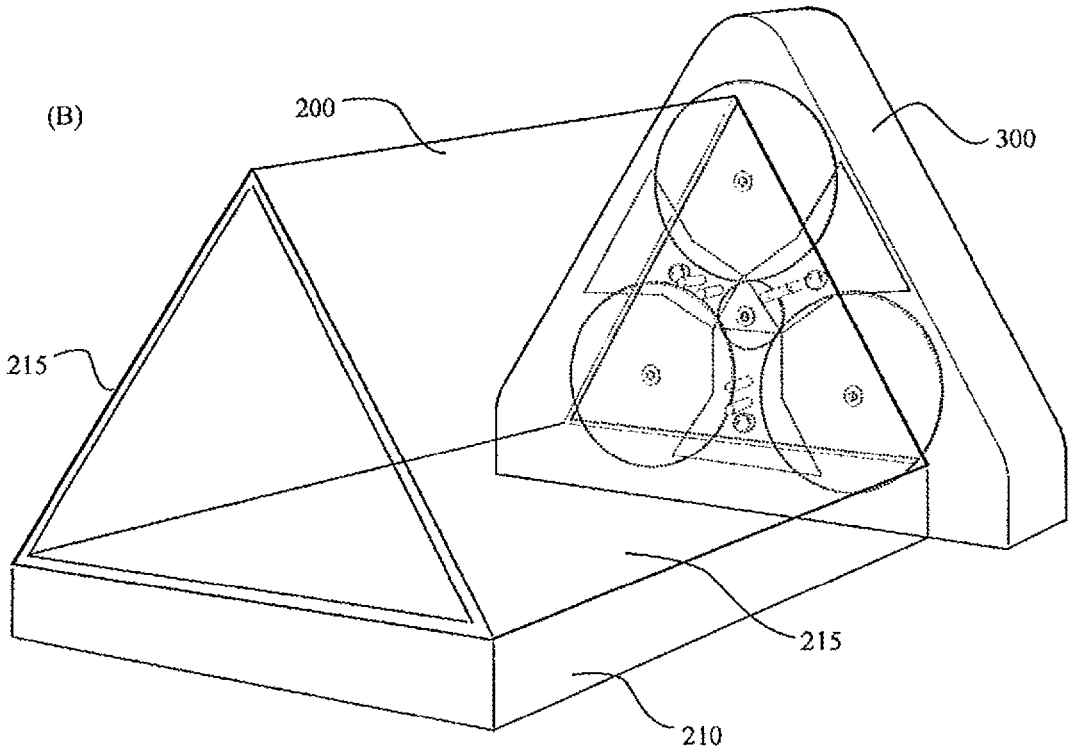

The endless belts 335 engaged to layered pulleys 330 may be fastened in parallel as usual, but as shown in FIG. 5(B), it may be engaged in the shape of an eight. An axis 330 can rotate in reverse by being engaged to the endless belt 335 in the shape of an eight. Then, as shown in FIG. 3 (A), a circle-shaped rotary board is fixed to the axis 330, and decoration stand 300 is formed. In accordance with exemplary embodiments, in placing an axis 330 at the position of a triangular vertex and the center of gravity, a small turn board 315 is located in the vicinity of the first end face center of the decoration stand 300, and three giant turn boards 310 are placed to surround the small turn board 315. Because a small pulley 341 secured to a drive shaft of the drive motor 340 rotates by drive of the drive motor 340, axes 330 rotate, and the turn boards (giant turn board 310, small turn board 315) secured to axes 330 will rotate.

Then, a decoration member is located on the circle-shaped rotary board. In accordance with exemplary embodiments, the turn boards are coated with a decoration sheet, and plural illuminations members such as the LED are placed on the decoration sheet. The decoration member is located so that among the domains of the first end face of decoration stand 300, when installed on the side of mount body 200, the entire surface of the domain (hereinafter called a kaleidoscope side domain) can be seen from the side of mount body 200. And a decoration sheet 360 is attached to fill the gap of each giant turn board 310. For example, decoration sheet 360 can use the material which garnished a transparence sheet with lame (means the textile which gold and silver threads or metal small gold and silver leaves were interwoven in) or the sheet which processed the surface with aluminum. Even more particularly, the surface of decoration sheet 360 may be processed on a transparent seat.

The first end face (the surface of the side where the decoration member was located) of decoration stand 300 configured as above will be established on the side (the direction where a decoration side of decoration stand 300 faces to the cavity of mount body 200) of mount body 200. In the state that maintained a gap where the turn board is rotatable, the decoration stand 300 will be placed on the side of the mount body 200. It goes without saying that the gap is coated by a shock absorber as will hereinafter be described in detail. Even more particularly, in the conditions where a part of the turn board protruded outside, the decoration stand 300 is installed, so as not possible to view the whole of the turn board from the inside of mount body 200.

Then, predetermined shock absorber 400 is coated to game apparatus 100 of the present invention.

For example, shock absorber 400 such as urethane of the predetermined thickness is attached on mount body 200 and decoration stand 300. The gap between the side of mount body 200 and the decoration stand 300 will be filled up with shock absorber 400. Note that instead of urethane, shock absorber 400 such as foams such as the polyethylene is preferably used. By coating a game apparatus 100 with shock absorber 400, even if a user mistakenly bumps the game apparatus by mistake, because a shock is cushioned by shock absorber 400, an injury of the user can be prevented effectively.

The shock absorber 400 may be processed. For example, processing to reduce appearance of shock absorber 400 to the shape such as rocks is performed. Even more particularly, the surface of shock absorber 400 may be stiffened to some extent. Next, a method of use of the game apparatus 100 of the present invention is described. In the present invention, because a turn board placed on decoration stand 300 rotates, the decoration member provided on the turn board rotates. Even more particularly, because a mirror 220 is attached inside of the mount body, when a user enters inside of mount body 200, a user may recognize the state that the decoration member is reflected in the mirror attached inside of mount body 200. An effect that a user is visible with the state that a rotating decoration member is reflected in the mirror is produced because a decoration member rotates. Even more particularly, of course user themselves is reflected in mirror 220, and by above effect, game apparatus 100 to make the continued interest of the user can be configured.

Thus, game apparatus 100 of the present invention can use the outside of mount body 200 as a normal chevron game apparatus 100, and like a kaleidoscope, an image reflected in mirror 220 attached inside of mount body 200 functions as a playground equipment changing in sequence. Even more particularly, the decoration stand 300 is installed, in the conditions where a part of the turn board protruded outside, so as not possible to view the whole of the turn board from the inside of mount body 200, so that an image full of changes can be projected on mirror 220.

INDUSTRIAL APPLICABILITY

In the present invention, the turn board which gave decoration rotates, and the rotative movement is reflected by a mirror for an inner wall of the mount body. Thereby, even if it is the game apparatus of the mount body shape, by changing a picture to be reflected in the mirror inside variously, a game apparatus making the continued interest of children is provided. Also, the gripping members such as ladders provided outside of mount body can assist a user to go up and down.

By coating a game apparatus 100 with shock absorber 400, even if a user bump to the game apparatus by mistake, because a shock is cushioned by shock absorber 400, the shock absorber can absorb a shock. Thus, the industrial applicability is provided. The embodiments and implementations that have been disclosed here are illustrative by nature are should not be regarded as limiting. The scope of the invention is defined by its claims rather than the foregoing description, and should be understood to include the features of the claims of the invention and equivalents thereof, in addition to all changes falling within the scope of the claims.

What is claimed is:

1. A game apparatus, comprising:

a mount body having a hollow cavity and an open end to allow a user to enter inside the mount body hollow cavity to play;

a mirror surface provided on an inner wall of the mount body;

a decoration stand provided outside of and adjacent an end of the hollow cavity of the mount body;

a decoration turn board defining a decoration surface of the decoration stand; and at least a part of the turn board is viewable from the hollow cavity of the mount body and is reflected by the mirror surface on the mount body inner wall.

2. The game apparatus according to claim 1, wherein the hollow cavity formed in the mount body is in a shape of polygon.

3. The game apparatus according to claim 1, further comprising a plurality of gripping members provided on the mount body for letting a user go up and down an outer surface of the mount body.

4. The game apparatus according to claim 1, wherein the surface of the game apparatus is coated in a shock absorber.

5. The game apparatus according to claim 1 wherein the shock absorber is urethane.

6. The game apparatus according to claim 1, wherein said mount body comprises a base having a generally planar upper surface defining a substantially horizontal floor of the hollow cavity.

7. The game apparatus according to claim 6, wherein said mount body further comprises angled sidewalls having first ends that join with the base and second ends that join with one another, said sidewalls and planar surface generally defining a triangle.

8. The game apparatus according to claim 7, wherein said angled sidewalls have interior surfaces which define with said base planar surface said inner wall of the mount body, said mirror surface being provided on said sidewall interior surfaces and said base planar surface.

9. The game apparatus according to claim 3, wherein the gripping members define a ladder.

10. The game apparatus according to claim 1, wherein opposite ends of the hollow cavity defined in said mount body are open.

* * * * *